US005310246A

United States Patent [19]

Tseng

[11] Patent Number: 5,310,246

[45] Date of Patent: May 10, 1994

[54] LAWN CHAIR

[76] Inventor: Chun-Chu Tseng, No. 3, Ting-Hsi-Hsin, Lu-Man Tsun, Chu-Chi Hsiang, Chiayi Hsien, Taiwan

[21] Appl. No.: 123,910

[22] Filed: Sep. 17, 1993

[51] Int. Cl.[5] ..... A47C 1/024

[52] U.S. Cl. ..... 297/359; 297/28; 297/411.42

[58] Field of Search ..... 297/16.1, 27, 28, 31, 297/359, 360, 411.42

[56] References Cited

U.S. PATENT DOCUMENTS

| | | | |
|---|---|---|---|
| 715,388 | 12/1902 | Kenny | 297/359 X |
| 3,186,757 | 6/1965 | Hopkins | 297/359 X |
| 4,784,432 | 11/1988 | Brown | 297/38 |
| 4,898,421 | 2/1990 | Brinn | 297/28 |

*Primary Examiner*—Peter R. Brown

*Attorney, Agent, or Firm*—Willian Brinks Hofer Gilson & Lione

[57] ABSTRACT

A foldable lawn chair includes a seat frame, a backrest frame connected pivotally to a rear end of the seat frame, and two arm support frames at two sides of the seat frame. Each of the arm support frames has an armrest portion provided with a positioning member that has a longitudinal slot, front and rear ends, upper and lower peripheries extending between the front and rear ends, a row of positioning notches along the upper periphery, and an access hole integrally formed with the longitudinal slot. A slide plate is sleeved slidably on the positioning member and has a longitudinal slot and a through-hole that is formed integrally with and that is communicated with the longitudinal slot thereof. When the slide plate slides together with a positioning stud of the backrest frame along the positioning member, the positioning notches in the positioning member are respectively covered by the slide plate and are exposed through the through-hole of the slide plate.

2 Claims, 10 Drawing Sheets

LAWN CHAIR

BACKGROUND OF THE INVENTION

1. Field of the Invention

The invention relates to a foldable lawn chair, more particularly to a lawn chair in which an angle between a seat frame and a backrest frame of the lawn chair can be easily adjusted.

2. Description of the Related Art

Referring to FIGS. 1 and 2, a conventional lawn chair includes a backrest frame 4, a seat frame assembly 3, two spaced arm support frames 1, two elongated positioning members 2 and two opposed positioning studs 41.

The seat frame assembly 3 includes a seat frame 30 which has a front end portion 31 and a rear end portion, and a rear leg frame 33 which has an upper end portion that is formed integrally with the rear end portion of the seat frame 30. A pivot seat 32 is fixed on the rear portion of the seat frame 30. The backrest frame 4 is connected pivotally to the pivot seat 32 of the seat frame 30 at the lower end portion thereof.

The arm support frames 1 are provided on two opposite sides of the backrest frame 4. Each of the arm support frames 1 has an intermediate portion which is connected pivotally to the front end portion 31 of the seat frame 30, a front leg portion 11 which extends downwardly and forwardly from the intermediate portion, and an armrest portion which extends upwardly and rearwardly from the intermediate portion.

The positioning members 2 are connected to the rear portion of the respective arm support frame 1. Each positioning member 2 has a longitudinal slot 21 with a front end, a rear end and a pair of upper and lower peripheries that extends between the front and rear ends, a row of upwardly and rearwardly extending positioning notches 23 which are formed along the upper periphery of the longitudinal slot 21, an access hole 22, and a restricted passage 24 which communicates the longitudinal slot 21 and the access hole 22.

The positioning studs 41 are secured to and extend outward from two opposite sides of the backrest frame 4. Each of the studs 41 is engaged within a selected one of the positioning notches 23 of the longitudinal slot 21 of the corresponding positioning member 2 and consists of a neck 410 and an enlarged head 411. The neck 410 is sized so as to be slidable from the longitudinal slot 21 through the restricted passage 24 and into the access hole 22. The enlarged head is sized so as to prevent removal of the corresponding positioning stud 41 from the longitudinal slot 21 and so as to be extensible through the access hole 22 when the corresponding neck 410 is moved to the access hole 22, thereby permitting separation of the positioning stud 41 from the positioning member 2. Each of the positioning studs 41 is movable so as to engage another one of the positioning notches 23 along the longitudinal slot 21 in order to change the angle between the backrest frame 4 and the seat frame 30 of the seat frame assembly 3.

Referring to FIGS. 3 and 4, when the necks 410 of the positioning studs 41 are disengaged from the positioning notches 23 and are slid into the access holes 22, the armrest portion of the arm support frame 1 is pulled outwardly so that the enlarged heads 411 can extend through the access hole 22 in order to separate the studs 41 from the positioning members 2. Thus, the backrest frame 4 is permitted to fold over the seat frame assembly 3, while the arm support frames 1 are allowed to rotate relative to the seat frame assembly 3 so as to align with the seat frame assembly 3.

Though the conventional lawn chair is foldable so as to facilitate transport and storage of the same, it still has a drawback. When the user is seated in the seat frame, adjustment of the backrest frame toward the seat frame can be performed easily. However, to perform a pivoting action of the backrest frame away from the seat frame, the user has to get up from the seat frame in order to facilitate the adjustment thereof, thus inconveniencing the seated person.

SUMMARY OF THE INVENTION

Therefore, a main objective of the present invention is to provide a foldable lawn chair which has a particular structure attached thereto so that the user can adjust an angle between the seat frame and the backrest frame easily without the need for getting up from the seat frame thereof.

A second objective of the present invention is to provided a foldable lawn chair that has a stopping unit attached to the positioning members of the arm support frame in the foldable lawn chair so that the arm support frame cannot disengage from the seat frame assembly, thereby ensuring the safety of the seated person.

According to the present invention, a slide plate is to be sleeved slidably on each of the positioning members which are attached respectively to the armrest portions of the arm support frames of the conventional lawn chair. The slide plate has a longitudinal slot and a through-hole which is formed integrally with and which is communicated with the longitudinal slot. The longitudinal slot of the slide plate is aligned with the longitudinal slot of the positioning member of the conventional chair. The through-hole of the slide plate is sized so as to permit passage of the enlarged head of the positioning stud. The longitudinal slot of the slide plate is sized in order to permit sliding movement of the neck of the positioning member so that, when the positioning stud slides along the positioning member in a rearward direction, the slide plate moves together with the positioning stud along the positioning member to cover a respective one of the positioning notches, thereby preventing the positioning stud from engaging into any one of the succeeding positioning notches. When the positioning stud is moved frontwardly along the positioning member, the through-hole of the slide plate exposes a preceding one of the positioning notches, thereby permitting the positioning stud to engage the preceding one of the positioning notches via the through-hole of the slide plate.

The foldable lawn chair further includes preferably two stopping units, such as two circular discs, disposed in the access holes of the positioning members so that the positioning studs cannot enter thereinto in order to prevent disengagement of the backrest frame from the arm support frame.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
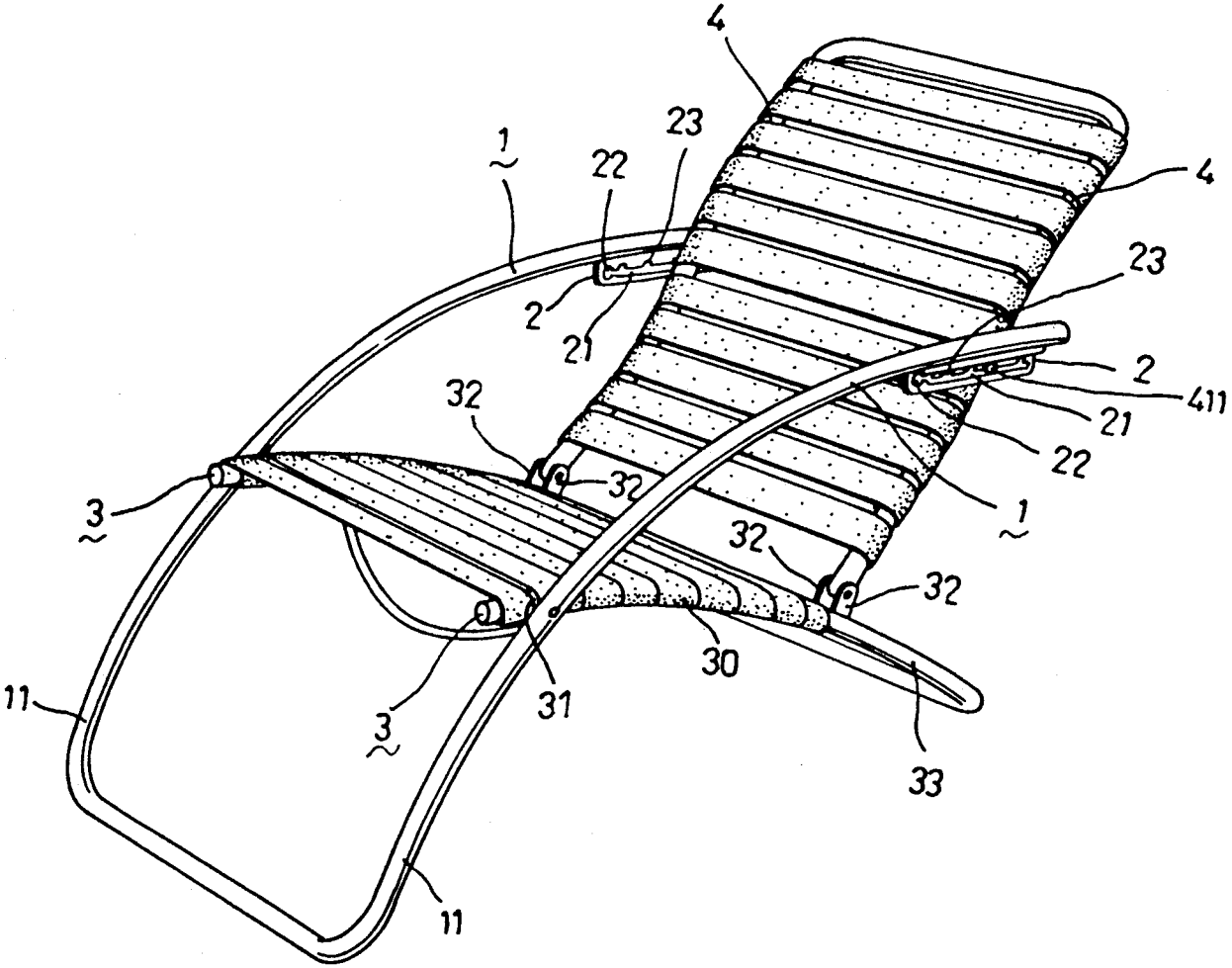
FIG. 1 (PRIOR ART)
FIG. 1 is a perspective view of a conventional lawn chair.
Figure 2:
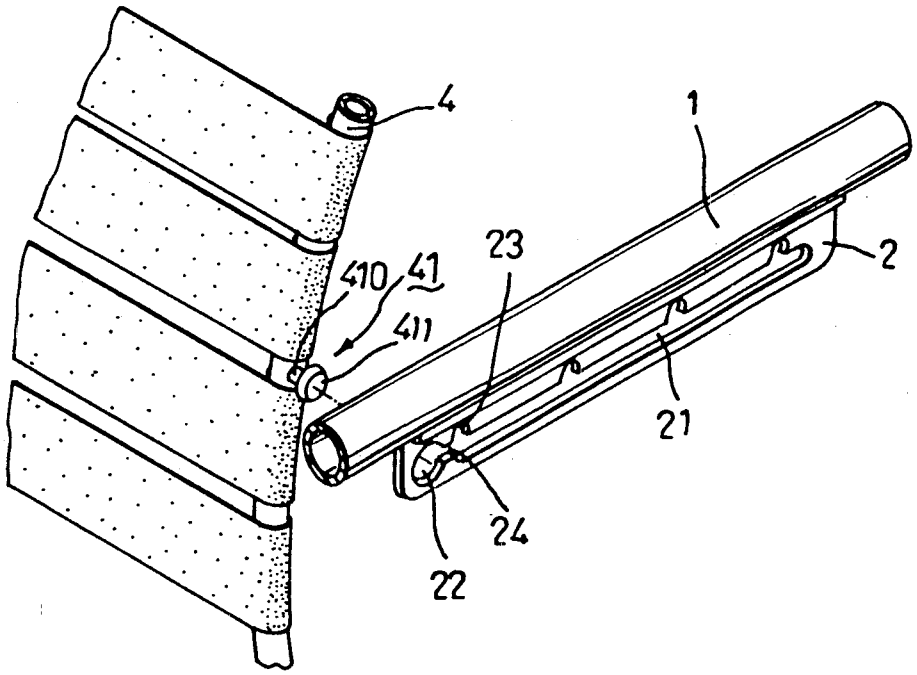
FIG. 2 (PRIOR ART)
FIG. 2 exploded view illustrating one of the positioning members and one of the positioning studs of the conventional lawn chair.
Figure 3:
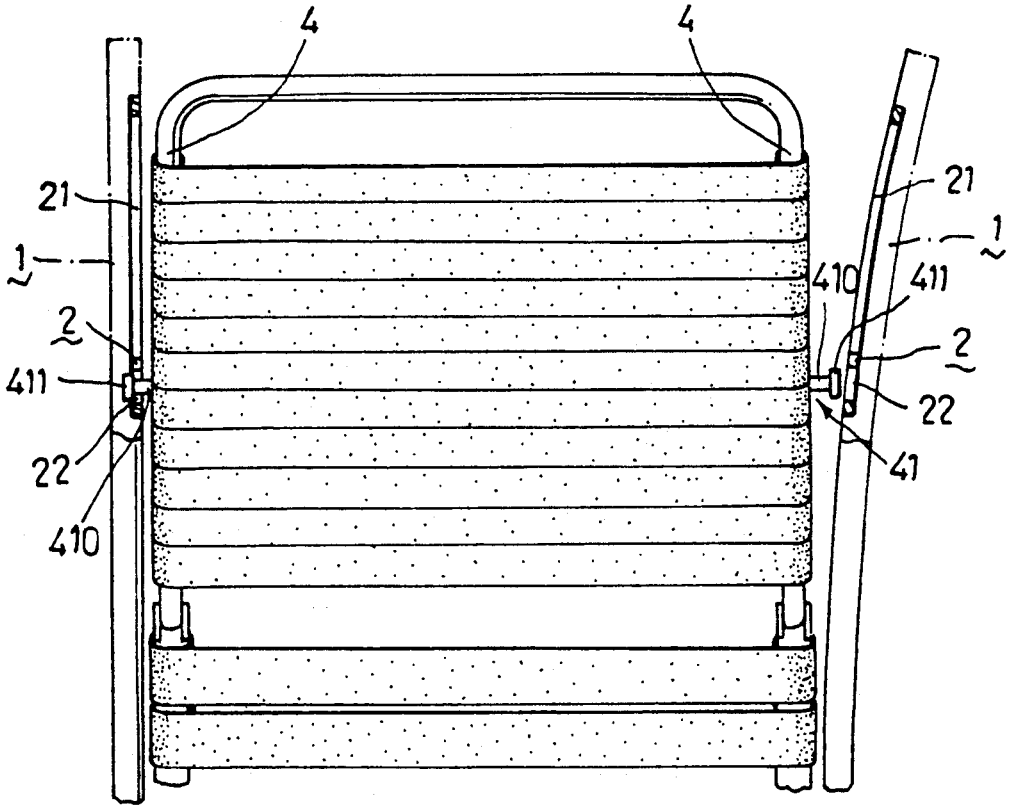
FIG. 3 (PRIOR ART)
FIG. 3 is a schematic view illustrating the separation of one of the positioning studs from the corresponding positioning member in the conventional lawn chair.
Figure 4:
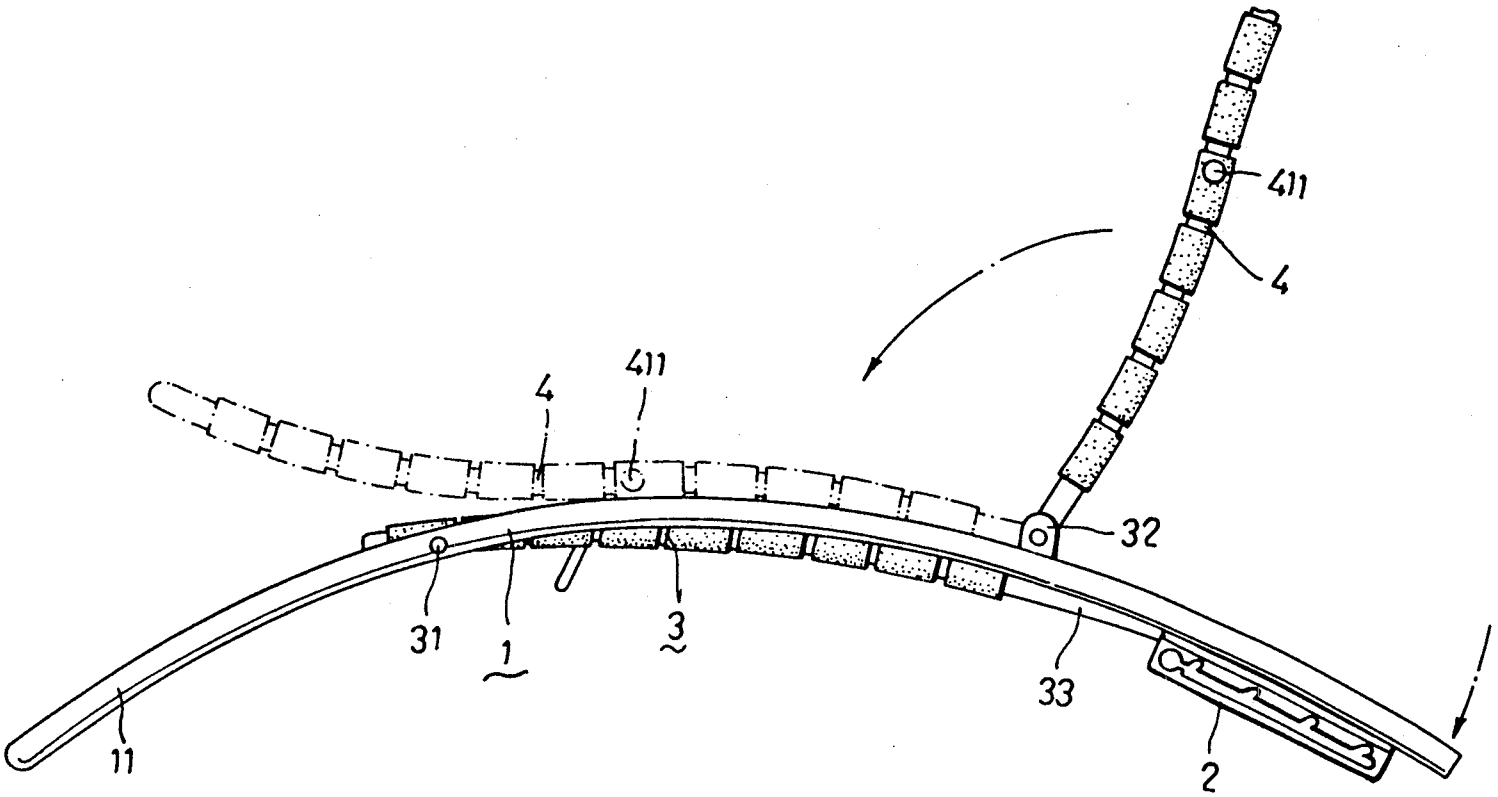
FIG. 4 (PRIOR ART)
FIG. 4 is a side view showing the folding movement of the backrest frame and the arm support frame relative to the seat frame assembly.

According to the present invention, a slide plate is to be installed in the conventional foldable lawn chair shown in FIGS. 1 to 4. The same reference numerals are used to denote similar elements throughout the specification.

Figure 5:
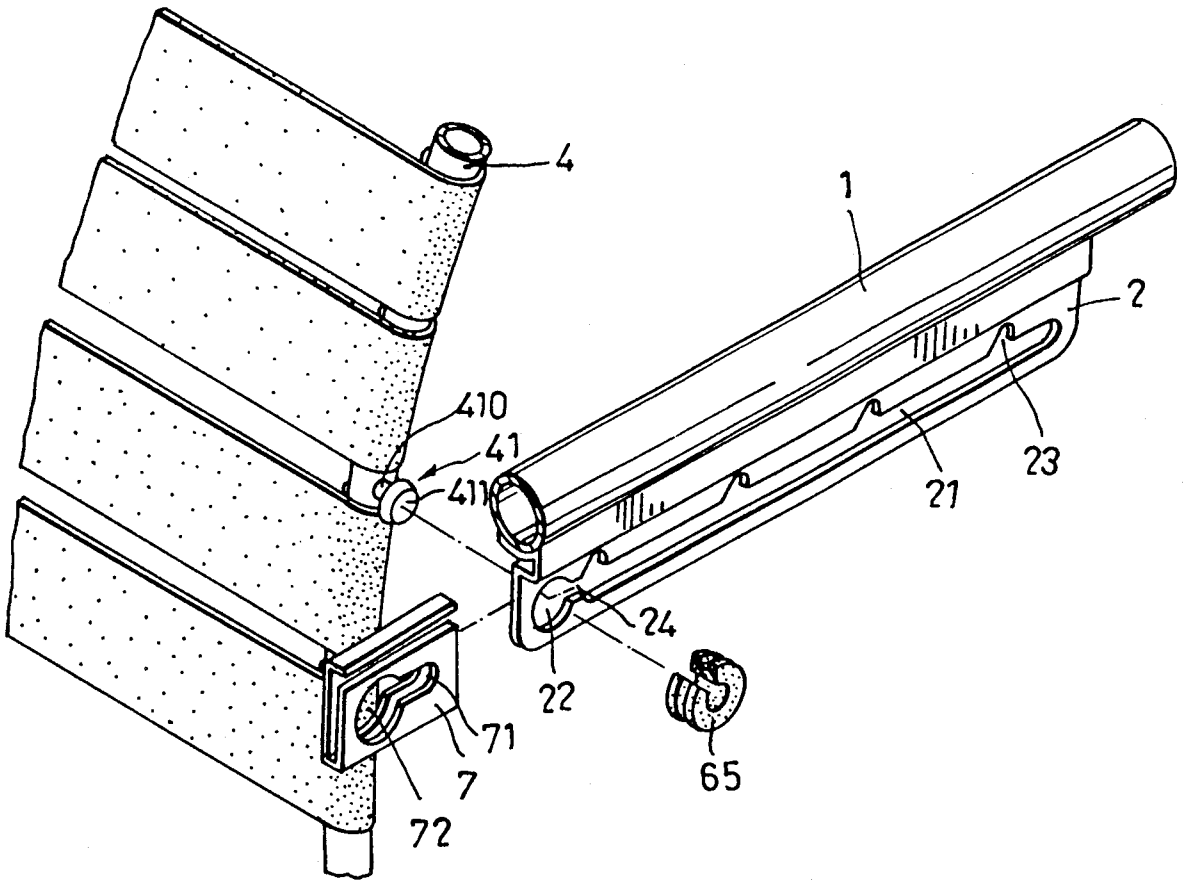
FIG. 5 is an exploded view illustrating one of the positioning members, one of the positioning studs of the conventional lawn chair and a slide plate which is to be sleeved on the positioning member according to the present invention.
Figure 6:
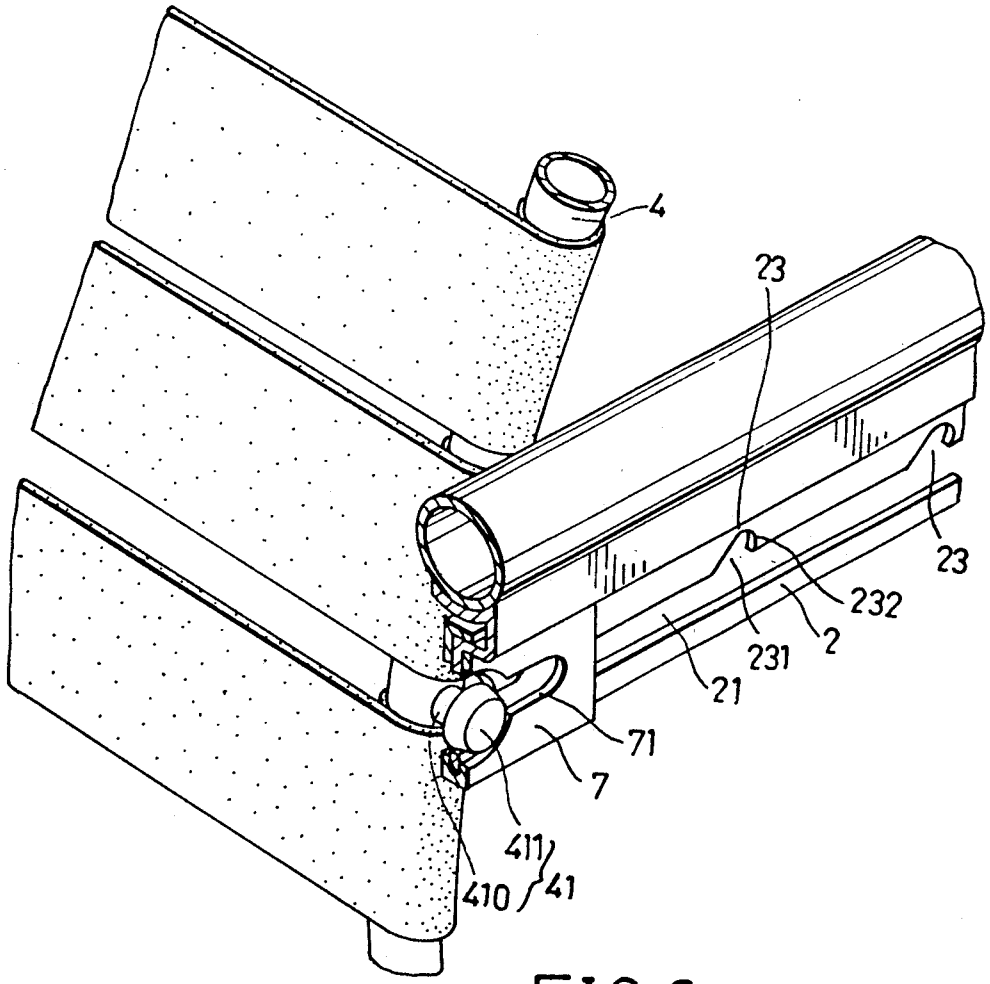
FIG. 6 is a partially cutaway view of an assembled of the positioning member and the slide plate of the present invention.

Referring to FIGS. 5 and 6, a slide plate 7 is sleeved slidably on the positioning member 2 of the armrest portion of the arm support frame 1 in a conventional foldable lawn chair. The positioning member 2 is provided with a longitudinal slot 21 which has a front end, a rear end and a pair of upper and lower peripheries extending between the front and rear ends, a row of upwardly and rearwardly extending positioning notches 23 formed along the upper periphery of the longitudinal slot 21, and an access hole 22 which is formed adjacent to the front end and which is communicated with the longitudinal slot 21. Each of the positioning notches 23 has straight side 232 and a inclined side 231. The slide plate 7 has a longitudinal slot 71 which is aligned with the longitudinal slot 21 of the positioning member 2, and a through-hole 72 which is formed integrally with and which is communicated with the longitudinal slot 71. The through-hole 72 of the slide plate 7 is sized so as to permit passage of the enlarged head 411 of the positioning stud 41 when the access hole 22 of the positioning member 2 and the through-hole 72 of the slide plate 7 are aligned and so as to expose one of the positioning notches 23 when the slide plate 7 moves along the positioning member 2. The longitudinal slot 71 of the slide plate 7 is sized so as to permit sliding movement of the neck 410 of the positioning stud 41. The slide plate 7 is constructed in such a manner that it covers each of the positioning notches 23 when moved along the positioning member 2, thereby preventing the positioning stud 41 from engaging the positioning notch 23 along its route.

Figure 7:
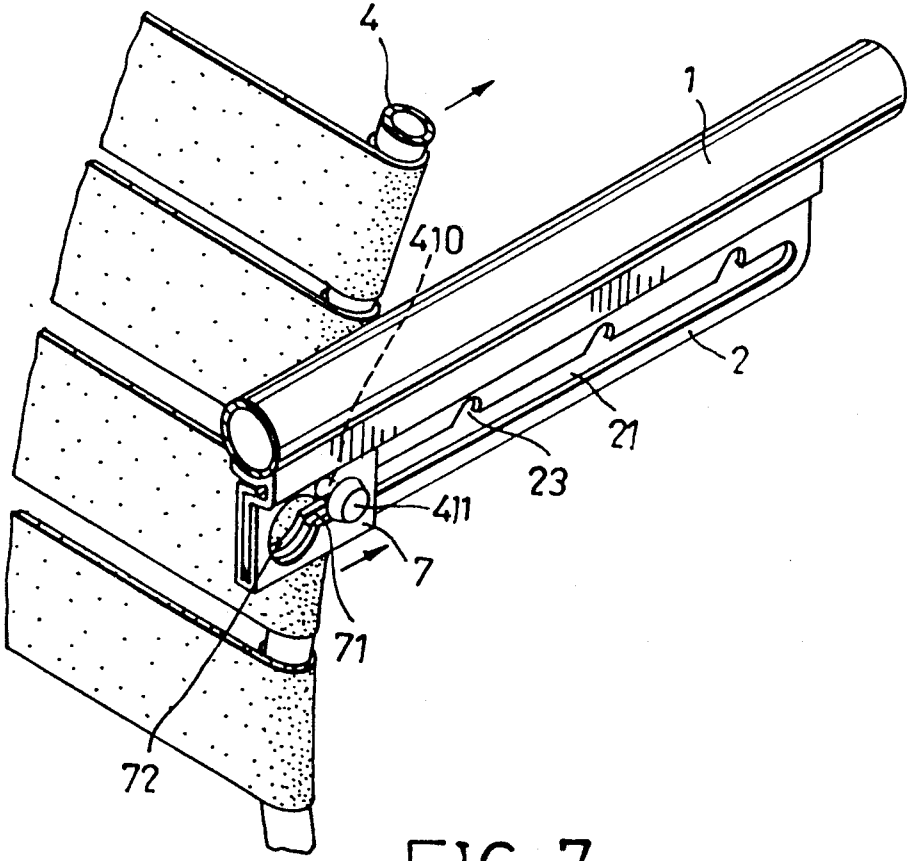
FIG. 7 illustrates an assembled view of the positioning member and the slide plate shown in FIG. 5.

Referring to FIG. 6, supposing that the positioning stud 41 of the lawn chair equipped with the slide plate 7 of the present invention extends through the access hole 22 of the positioning member 2 and the through-hole 72 of the slide plate 7, the seated person can push the backrest frame 4 without standing up from the seated frame so as to pivot the former in the direction as shown by the arrow in FIG. 7. The positioning stud 41 is moved correspondingly in the same direction, thereby simultaneously pushing the slide plate 7. As the slide plate 7 moves along the positioning members 2 along the direction indicated by the arrow, the slide plate 7 covers the inclined and straight sides 231, 232 of a respective one of positioning notches 23 so that the positioning stud 41 cannot engage in any one of the positioning notches 23. Thus, the positioning stud 41 can reach a rearmost end of the positioning member 2, as shown in FIG. 8.

Figure 8:
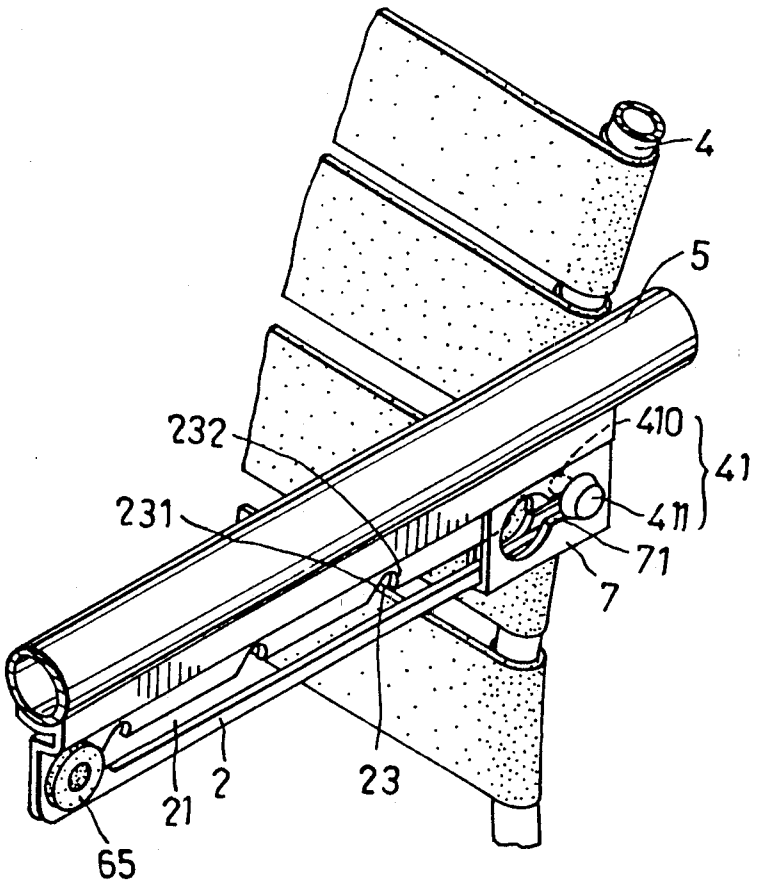
FIG. 8 is a backrest frame of the lawn chair equipped with slide plate of the present invention, the backrest frame being pivoted so as to be disposed farthest from the seat frame.
Figure 9:
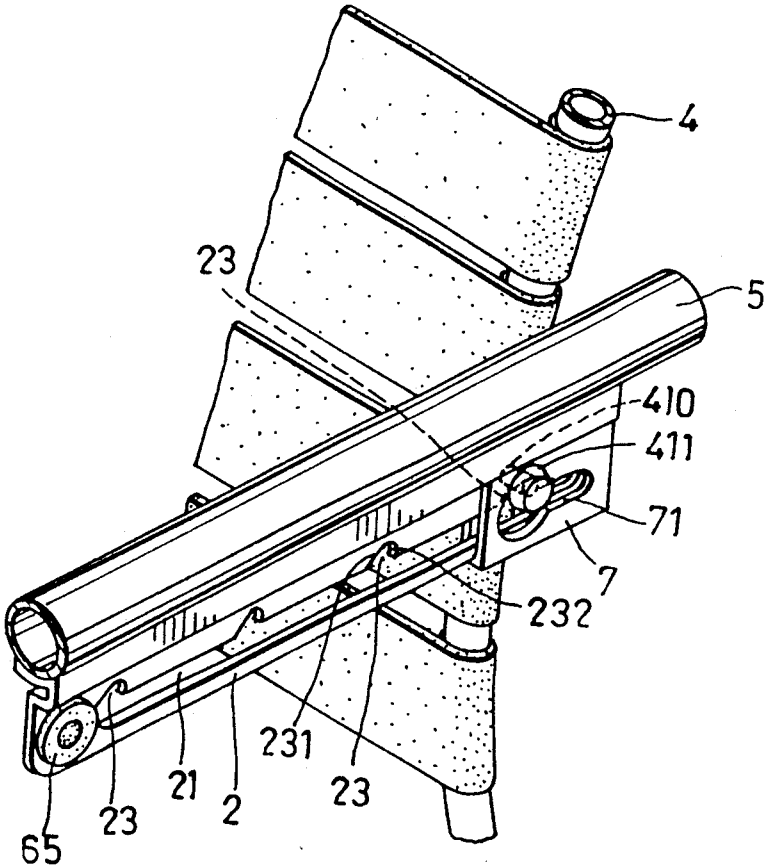
FIG. 9 the positioning stud of the lawn chair equipped with the slide plate of the present invention when engaging a positioning notch of the armrest portion.
Figure 10:
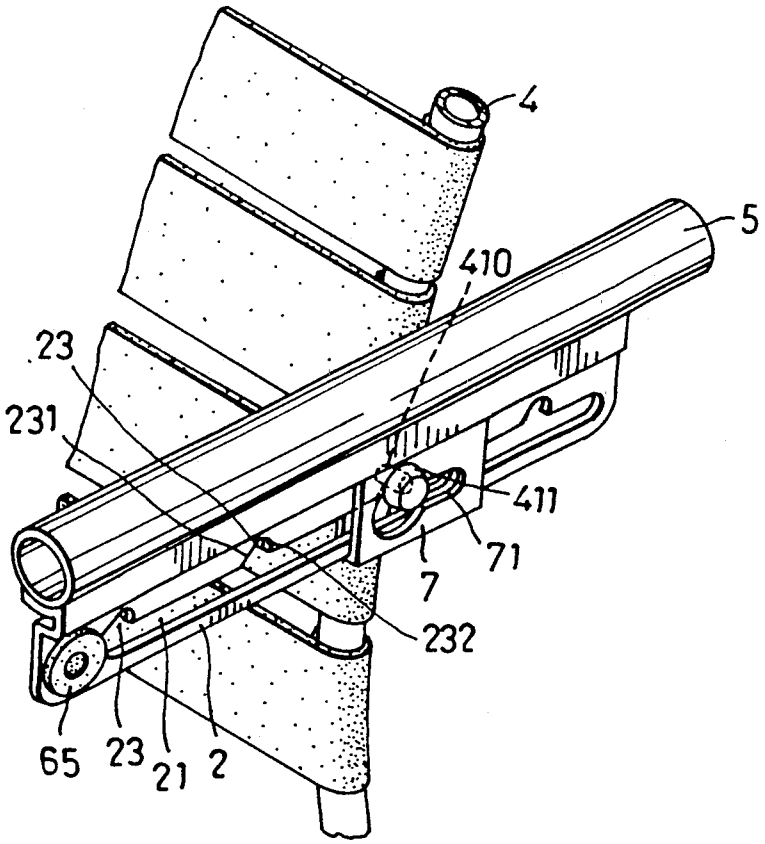
FIG. 10 shows the positioning stud of the lawn chair in FIG. 9 when engaging another positioning notch of the armrest portion.

Referring to FIG. 9, the seated person can pivot the backrest frame 4 from the position shown in FIG. 8, toward the seat frame 3 by pushing the backrest frame 4 in a direction shown by the arrow. The pivotal action of the backrest frame 4 correspondingly causes the positioning stud 41 to move toward the front end of the positioning member 2. The positioning stud 41 engages a preceding positioning notch 23 of the positioning member 2 upon reaching the through-hole 72 of the slide plate 7 because the preceding positioning notch 23 is not covered by the slide plate 7 and is exposed through the through-hole 72. In the event that the seated person wishes desires to make the backrest frame 4 to lean forward further, the positioning stud 41 can be pushed farther so as to be closer to the front end of the positioning member 2 by the pivotal action of the backrest frame 4 in the above-mentioned manner. The pivotal action of the backrest frame 4 compresses the positioning stud 41 downwardly and rearwardly so as to slide downward along the inclined side 231 of the engaging positioning notch 23, thereby disposing the stud 41 in the through-hole 72 of the slide plate 7. Under such a condition, since the slide plate 7 does not cover the inclined and straight sides 231, 232 of a preceding positioning notch 23 and since the latter is exposed through the through-hole 72 of the slide plate 7, the positioning stud 41 engages the preceding positioning notch 23 due to the weight of the arm support frame and due to the weight of the seated person. Thus, the backrest frame 4 in FIG. 10 is located more closer to the seat frame (not shown) than the position shown in FIG. 9.

In order to prevent disengagement of the backrest frame 4 from the positioning member 2 of the lawn chair which is installed with the slide plate 7 of the present invention, two stopping unit 65, such as two disc members, can be respectively and detachably disposed in the access-hole 22 of the positioning member 2 so that the positioning stud 41 cannot slide thereinto. In the event that the backrest frame 4 and arm support frame 3 of the lawn chair are to be separated in order to facilitate transport and storage of the lawn chair, the stopping units 65 are removed from the access holes 22 of the positioning members 2.

It has been shown that the backrest frame of the lawn chair with the slide plate of the present invention can be moved easily with respect to the seat frame without the need for the seated person to get off from rising off the seat frame. The objective of this invention is thus achieved.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A lawn chair including a seat frame with a rear end portion, a backrest frame with a lower end portion which is connected pivotally to said rear end portion of said seat frame, and two spaced arm support frames provided on two opposite sides of said backrest frame, each of said arm support frames having an armrest portion;

two elongated positioning members connected respectively and securely to said armrest portions of said arm support frames, each of said positioning members having a first longitudinal slot which has a front end, a rear end and a pair of upper and lower peripheries extending between said front and rear ends, a row of upwardly and rearwardly extending positioning notches which are formed along said upper periphery of said first longitudinal slot, and an access hole which is formed adjacent to said front end and which is communicated with said first longitudinal slot;

two opposed positioning studs respectively secured to two opposite sides of said backrest frame and extending through said first longitudinal slot of said positioning member so as to engage one of said positioning notches, each of said positioning studs having a neck and an enlarged head, said neck being sized so as to be slidable from said first longitudinal slot to said access hole, said enlarged head being sized so as to prevent removal of said stud from said first longitudinal slot and so as to be detachable from said access hole, thereby permitting said positioning stud to separate from said positioning member, wherein the improvements comprising:

each of said positioning members further having a slide plate sleeved slidably thereon, said slide plate having a second longitudinal slot aligned with said first longitudinal slot and a through-hole which is formed adjacent to a front end thereof and which is formed adjacent to a front end thereof and which is formed integrally with and which is communicated with said second longitudinal slot, said through hole being sized so as to permit passage of said enlarged head of said positioning stud, said second longitudinal slot being sized to permit sliding movement of said neck of said positioning stud, said slide plate being capable of covering each of said positioning notches when sliding along said positioning member, thereby preventing said neck of said positioning stud from engaging thereinto, said through-hole being capable of exposing each of said positioning notches, thereby permitting said positioning stud to be engaged therein with said positioning stud being disposed within said through-hole of said slide plate while engaging a selected one of said positioning notches of said positioning member when said slide plate slides along said positioning member.

2. The lawn chair as defined in claim 1, further comprising two stopping units respectively provided in said access hole of said positioning members so as to prevent said positioning studs of said backrest frame from entering thereinto in order to prevent said positioning studs from disengaging a respective one of said positioning members.

* * * * *

UNITED STATES PATENT AND TRADEMARK OFFICE

CERTIFICATE OF CORRECTION

PATENT NO. : 5,310,246
DATED : May 10, 1994
INVENTOR(S) : Chun-Chu Tseng

It is certified that error appears in the above-indentified patent and that said Letters Patent is hereby corrected as shown below:

In column 2, line 22 delete "provided" and insert --provide--.

In column 3, line 1 after "2" insert --is an--.
In column 3, line 24 after "9" insert --shows--.

In claim 1, column 6, line 12 delete "formed adjacent to a front end thereof and which is".

Signed and Sealed this
First Day of November, 1994

*Attest:*

*Attesting Officer*

BRUCE LEHMAN

*Commissioner of Patents and Trademarks*